US005365896A

United States Patent [19]

Hara et al.

[11] Patent Number: 5,365,896

[45] Date of Patent: Nov. 22, 1994

[54] CAM SHAFT ASSEMBLY FOR USE IN INTERNAL COMBUSTION ENGINE

[75] Inventors: Seinosuke Hara; Yoshihiko Yamada; Shoji Morita; Yukio Yamakawa; Akira Hidaka, all of Atsugi, Japan

[73] Assignee: Unisia JECS Corporation, Kanagawa, Japan

[21] Appl. No.: 77,510

[22] Filed: Jun. 17, 1993

[30] Foreign Application Priority Data

Jun. 17, 1992 [JP] Japan ..... 4-157909
Jun. 30, 1992 [JP] Japan ..... 4-172665

[51] Int. Cl.[5] ..... F01L 1/34
[52] U.S. Cl. ..... 123/90.17; 123/90.31
[58] Field of Search ..... 123/90.15, 90.16, 90.17, 123/90.31

[56] References Cited

U.S. PATENT DOCUMENTS

| | | | |
|---|---|---|---|
| 3,633,555 | 1/1972 | Raggi | 123/90.17 |
| 4,958,531 | 9/1990 | Parsons | 123/90.31 |
| 5,056,478 | 10/1991 | Ma | 123/90.17 |
| 5,080,053 | 1/1992 | Parsons | 123/90.17 |
| 5,148,783 | 9/1992 | Shinkai et al. | 123/90.17 |
| 5,161,493 | 11/1992 | Ma | 123/90.17 |
| 5,199,393 | 4/1993 | Baldassini | 123/90.17 |

FOREIGN PATENT DOCUMENTS

| | | |
|---|---|---|
| 57-198306 | 12/1982 | Japan . |
| 1311562 | 3/1973 | United Kingdom . |

*Primary Examiner*—E. Rollins Cross
*Assistant Examiner*—Weilun Lo
*Attorney, Agent, or Firm*—Foley & Lardner

[57] ABSTRACT

A cam shaft assembly comprises a first coupling between a drive collar rotatable with a driving shaft and an annular disc at a first position spaced from the shaft axis, and a second coupling between the disc and said hollow cam at a second position angularly spaced from said first position with respect to the shaft axis. The first and second couplings are so spaced from the shaft axis that they are at varying distances from the axis of the disc during operation. Each of the first and second couplings has a movable connection with the disc to permit the variation in its distance from the axis of the disc. The disc is rotatably supported in a disc housing. A control rod is mounted for rotation and has an eccentric control cam which controls movement of the disc housing. A pivot shaft extends through the disc housing for allowing movement of the disc housing following the eccentric control cam in which said plurality of hollow cams are disposed.

14 Claims, 19 Drawing Sheets

CAM SHAFT ASSEMBLY FOR USE IN INTERNAL COMBUSTION ENGINE

RELATED COPENDING APPLICATIONS

U.S. patent application Ser. No. 08/008,801, filed Jan. 27, 1993, now U.S. Pat. No. 5,333,579 by Seinosuke HARA et al., entitled "CONTROL DEVICE FOR CONTROLLING INTAKE AND EXHAUST VALVES OF INTERNAL COMBUSTION ENGINE"

British Patent Application No. 9301590.7

German Patent Application No. P 4302246.4

BACKGROUND OF THE INVENTION

The present invention relates to a cam shaft assembly for use in an internal combustion engine to control the opening and closing of intake and/or exhaust valves.

GB-A 1 311 562 discloses a device for moving a cam relative to its driving shaft. This device is applicable to an internal combustion engine to vary the movement of the cams which control the intake and/or exhaust valves of the engine. This known device comprises a drive member rotatable with a driving shaft, and an intermediate member mounted in an external bearing which is eccentric with respect to the shaft. The shaft extends through an opening in the intermediate member dimensioned to allow limited movement of the bearing to vary the eccentricity. A cam is coaxial with the shaft and rotatable relative thereto. The device includes a first coupling between the drive member and the intermediate member at a first position spaced from the shaft axis, and a second coupling between the intermediate member and the cam at a second position angularly spaced from the first position with respect to the shaft axis. The two couplings are so spaced from the shaft axis that they are at varying distances from the axis of the intermediate member during operation. Each of these couplings has a movable connection with the intermediate member to permit the variation in its distance from the axis of the intermediate member.

SUMMARY OF THE INVENTION

An object of the present invention is to improve the above mentioned mechanism such that a support forming a bearing rotatably supporting an intermediate member can vary the eccentricity of the intermediate member smoothly and can hold its position during operation of the engine.

Another object of the present invention is to improve the mechanism such that its components can be assembled and adjusted easily and can be installed on the engine easily.

According to the present invention, there is provided a cam shaft assembly for use in an internal combustion engine with a cylinder head to control opening and closing of intake and exhaust valves thereof, the assembly comprising:

a driving shaft rotatable about a shaft axis;

a cam rotatable relative to said driving shaft, said cam having a drive connection from said driving shaft which includes a drive member rotatable with said driving shaft, a support, an intermediate member supported in said support for rotation about an axis so as to rotate eccentrically with respect to said shaft axis, a first coupling between said drive member and said intermediate member at a first position spaced from said shaft axis, and a second coupling between said intermediate member and said cam at a second position angularly spaced from said first position with respect to said shaft axis, said first and second couplings being so spaced from said shaft axis that they are at varying distances from the axis of said intermediate member during operation, each of said first and second couplings having a movable connection with said intermediate member to permit the variation in its distance from said axis of said intermediate member;

means for holding said support for movement within a plane perpendicular to said shaft axis; and means for varying the eccentricity of said intermediate members, wherein said eccentricity varying means includes a control rod mounted for rotation about an axis, said control rod having a control cam for controlling movement of said support, and said support holding means includes pivot means for allowing movement of said support following said control cam.

DESCRIPTION OF THE EMBODIMENTS

Figure 1:
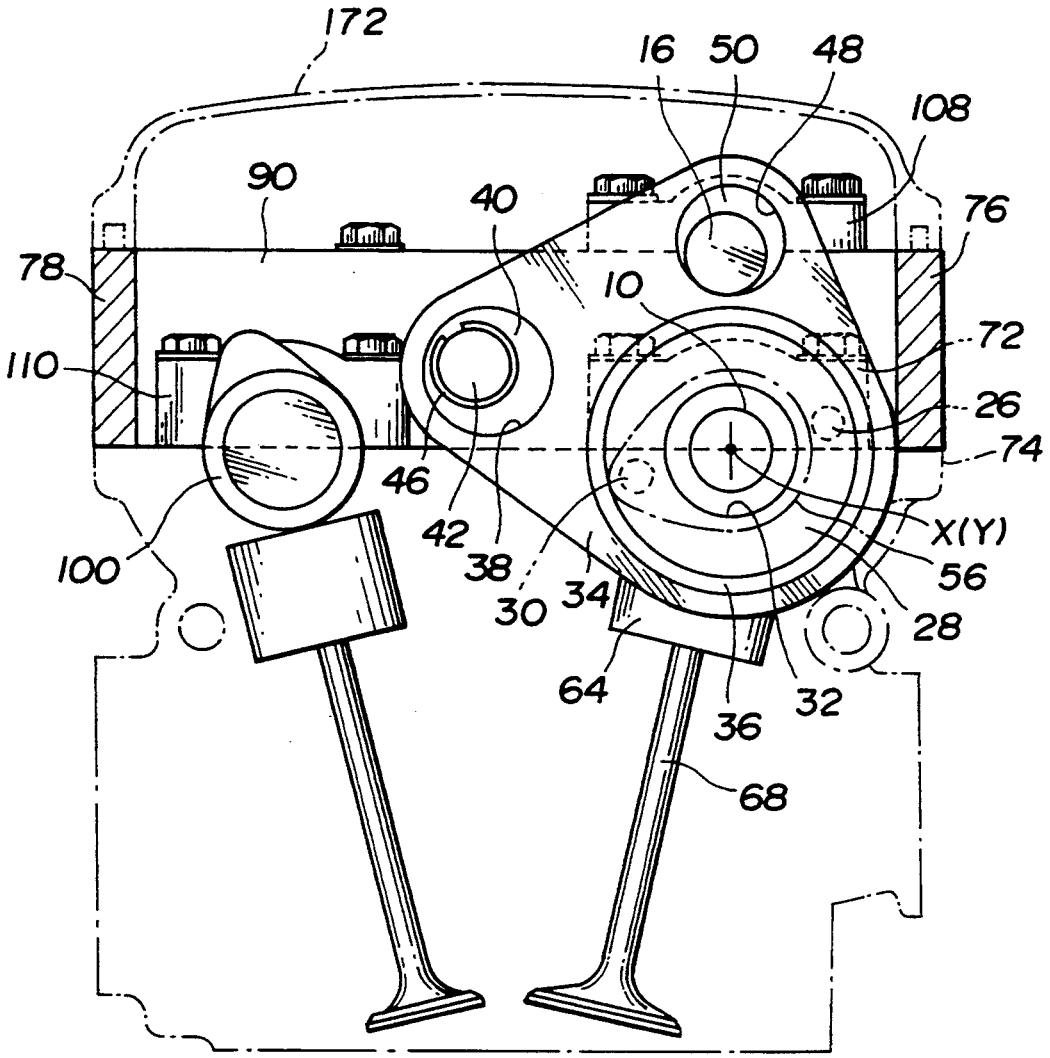
FIG. 1 is an enlarged cross section, taken through the line E—E in FIG. 2, showing a first embodiment of a cam shaft assembly according to the present invention.

Referring to the accompanying drawings, like reference numerals are used to designate like or similar parts throughout all Figures.

A first embodiment of a cam shaft assembly according to the present invention is described in connection with FIGS. 1 through 6.

Basically, the assembly comprises a drive member, in the form of a drive collar, rotatable with a driving shaft. The drive collar is formed with a radial slot. An intermediate member, in the form of an annular disc, has a pin projecting from its one face into the radial slot of the drive collar. The annular disc is fitted around the driving shaft with ample radial clearance, and has another pin projecting from its opposite face into a radial slot cut in a driven collar, forming an integral part of a cam whose movement is being controlled. The cam is mounted on the driving shaft for rotation relative thereto. The disc is supported in a bearing of a support or a disc housing which itself can be moved to vary the eccentricity of the disc with respect to the driving shaft. By reason of the differing positions in which this disc can be placed within the plane of rotation, and thus by reason of the different positions of the radial slot of the drive collar engaged by the pin of the disc and the radial slot of the driven collar engaged by the pin of the disc, the angular velocities imparted to the cam at different rotational positions can be varied.

The mechanism will now be considered in more detail.

Figure 2:
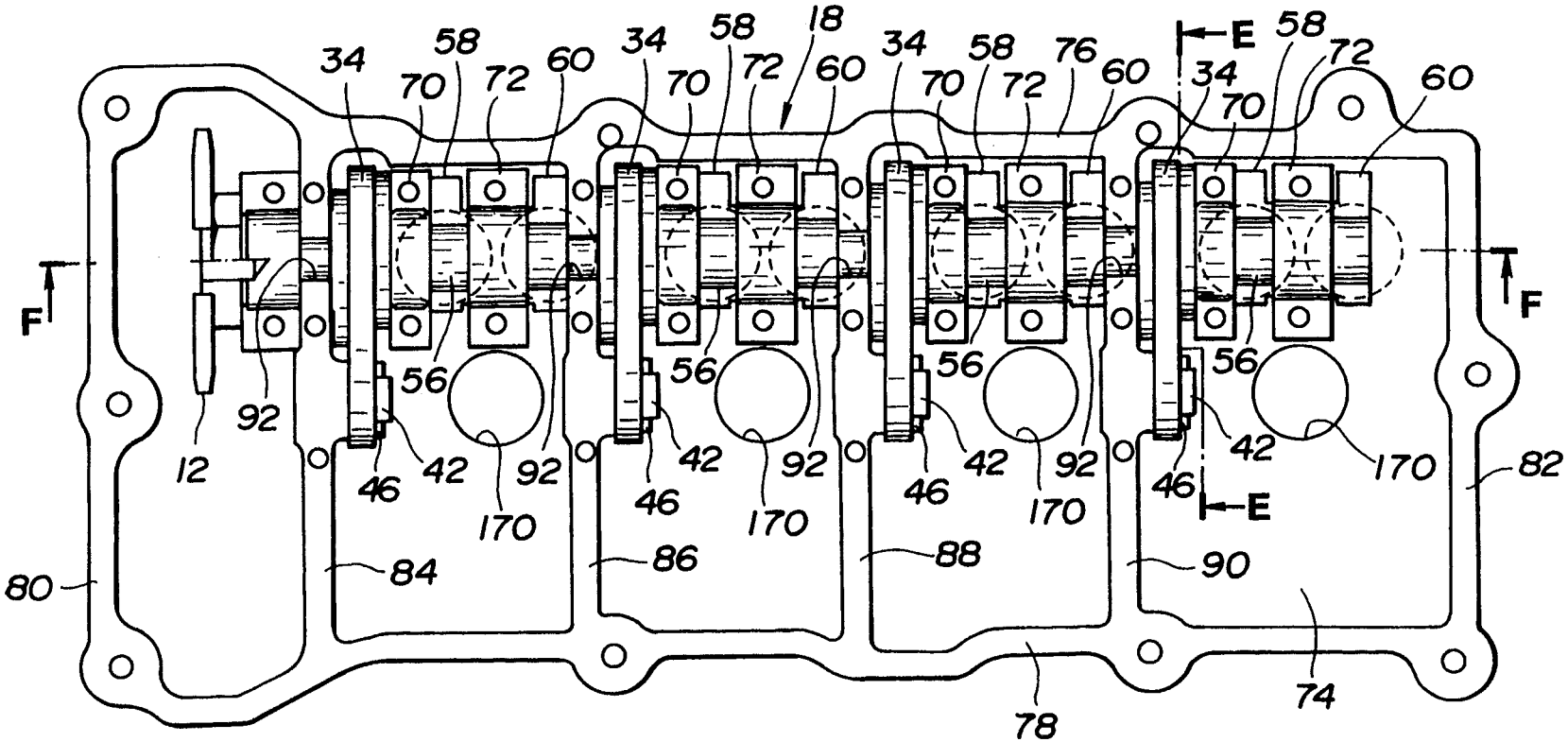
FIG. 2 is a plan view of the assembly as a whole as installed on the engine cylinder head.
Figure 3:
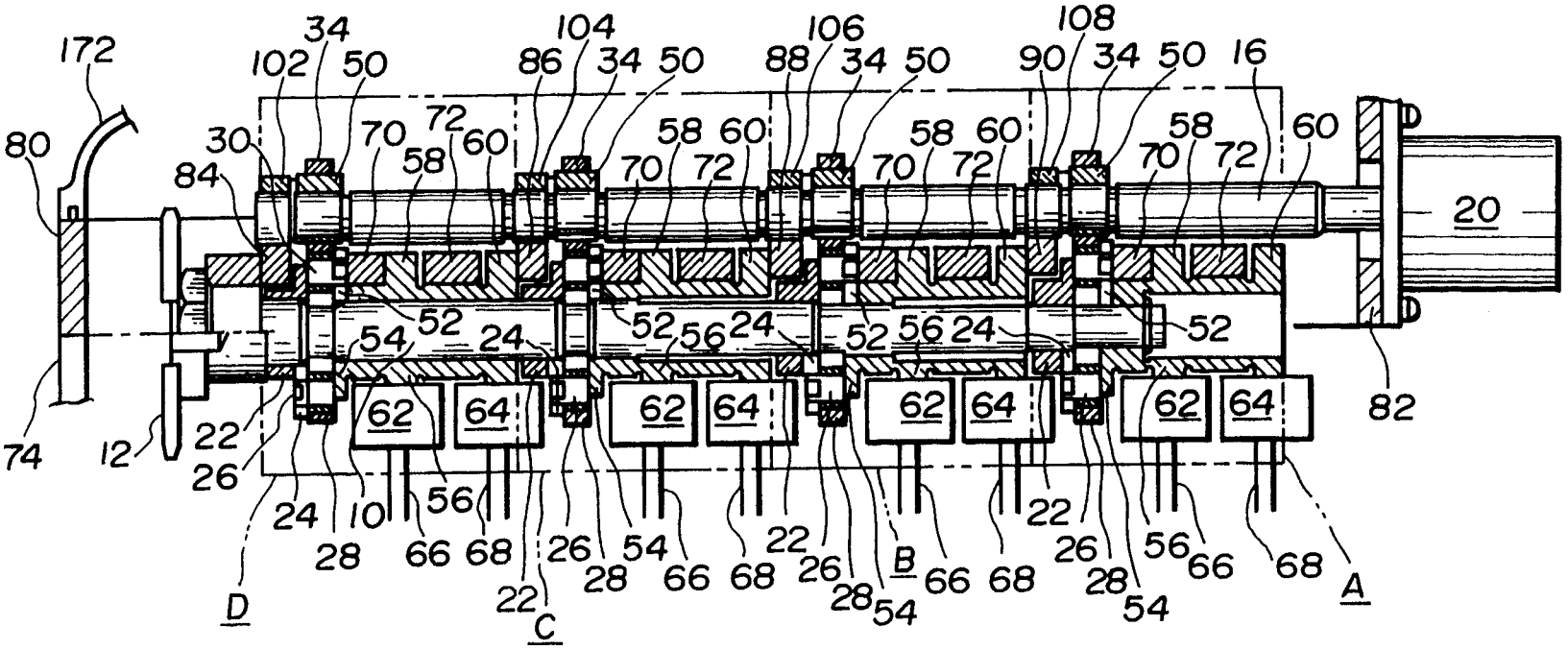
FIG. 3 is a longitudinal section taken through the line F—F in FIG. 2.

In FIGS. 2 and 3, the mechanism is shown four times. For ease of references, each of four substantially the same versions is encircled by a broken line rectangle marked A, B, C or D. In each of these versions, the mechanism is applied to one double cam with two cam lobes which control tappets of two intake valves for the corresponding one of four cylinders of an internal combustion engine.

Figure 6:
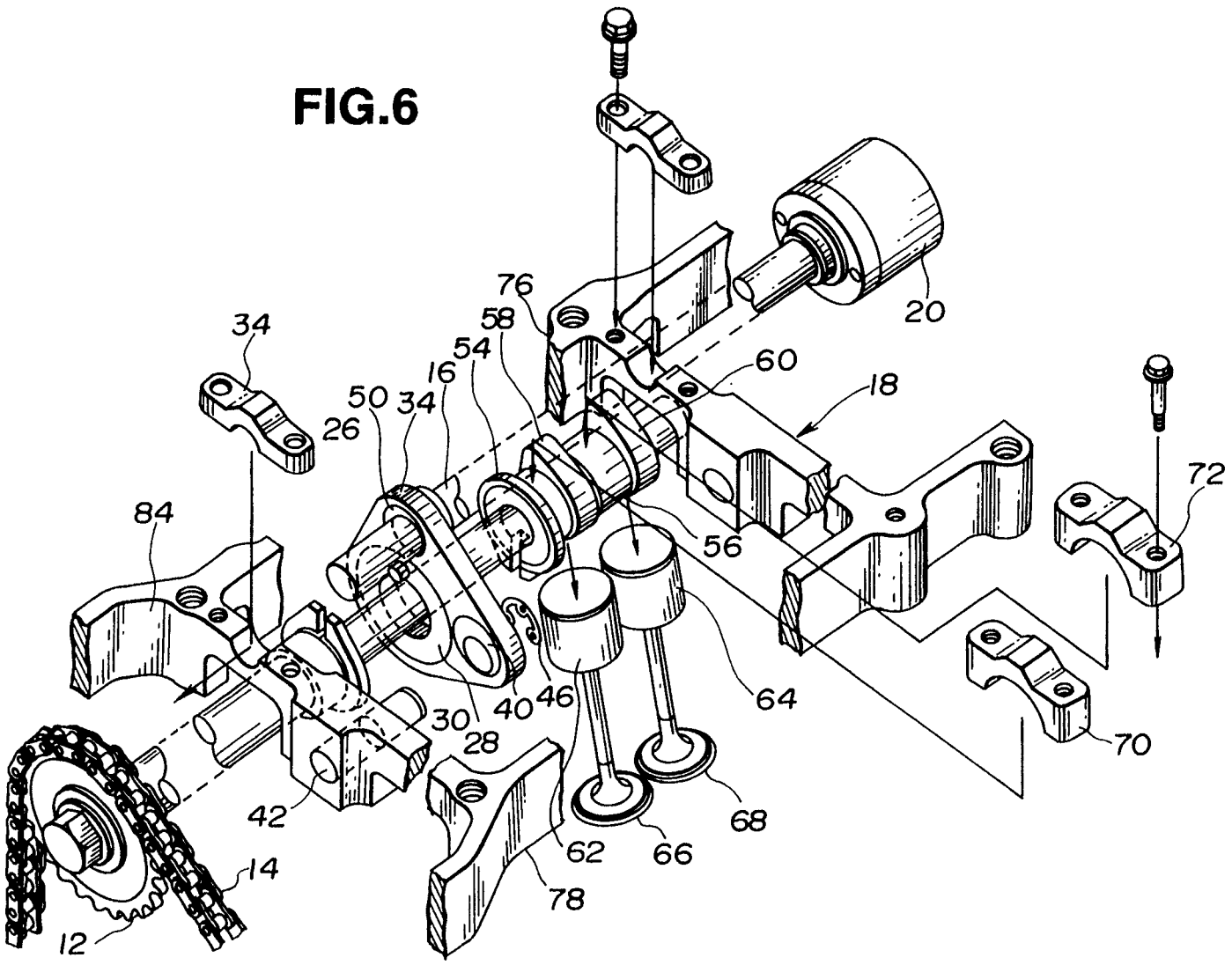
FIG. 6 is a fragmentary exploded view showing the relative position of components of the mechanism.

A driving shaft 10 which drives all the cams, is rotatable by a toothed wheel 12 and a chain 14 (see FIG. 6). The cams are not integral with the shaft 10, but rotatable relative to the shaft 10. Their movement is restricted in a longitudinal direction.

A control rod 16, with integral eccentric control cams which move all of the disc housings to vary the eccentricity of the annular discs, is rotatably supported in grooves cut into tops of beams of a framing structure 18. The control rod 16 is rotatable by an actuator 20 rigidly attached directly to the framing structure 18.

The mechanism shown inside rectangle A will be particularly considered since those in rectangles B, C and D operate in the same way.

A drive collar 22 is rigidly attached to the shaft 10 and it is formed with a radial slot 24. The radial slot 24 is slidably engaged in a first pin 26 of an annular disc or intermediate member 28. The pin 26 is rotatably supported by the disc 28 and projects from one face of the disc 28 into the radial slot 24. Projecting from the opposite face of the disc 28 is a second pin 30 which is symmetrical to and preferrably at an angle of 180° to the first pin 26.

The central hole 32 of the disc 28 is wide and the disc 28 does not touch the surface of the driving shaft 10, but is free to move into positions eccentric with respect to the driving shaft 10. A disc housing or support 34 forms a bearing 36 which supports the disc 28 for rotation. The disc housing 34 is movable to move the disc 28 in a plane perpendicular to the axis of the shaft 10. The disc housing 34 has a first hole 38 which rotatably couples with an eccentric collar 40 rotatably supported by a pivot shaft 42 which is rigidly attached to the adjacent beam of the framing structure 18. With a C-ring 46, the removal of the eccentric collar 40 from the pivot shaft 42 is prevented. The disc housing 34 has a second hole 48 which is rotatably coupled with an eccentric control cam, 50, forming an integral part of the control rod 16.

The second pin 30 is rotatably supported by the disc 28 and can slide along a radial slot 52 in a driven collar 54, forming an integral part and thus rotatable with a cam 56. The cam 56 is freely rotatable on the shaft 10, but cannot slide in a longitudinal direction. The cam 56 has two cam lobes 58 and 60 which control tappets 62 and 64 of two intake valves 66 and 68 for one cylinder.

The cam 56 is supported through two cam brackets 70 and 72, by the engine cylinder head 74. The shaft 10 is supported, through the driven collar 54 of the cam 56 and the driven collars of the other cams, by the engine cylinder head 74.

The framing structure 18 includes two parallel side rails 76 and 78 extending in a longitudinal direction of the engine cylinder head 74. The side rails 76 and 78 have their front ends interconnected by a front end beam 80. Their rear ends are interconnected by a rear end beam 82. The framing structure 18 is supported, through rigid attachement of the side rail 76 to the intake valve side portion and through rigid attachement of the other side rail 78 to the exhaust valuve side portion, by the engine cylinder head 74. Between the front and rear end beams 80 and 82, four beams 84, 86, 88 and 90 are connected between the side rails 76 and 78 in parallel. The beam 90, extending tranversely between the side rails 76 and 78, has its top side formed with a groove 92 for rotatably supporting the control rod 16. A hole 94 is drilled through a portion of the beam 88 located distant from each of the side rails 76 and 78. The associated pivot shaft 42 is rigidly supported in the hole 94 with press fit. Cut in the bottom side of the beam 90 are a first cutout 96 and a second cutout 98. The first cutout 96 is located below the groove 92 and partly encircles the sleeve portion of the associated drive collar 22 with a radial clearance. The second cutout 98 is located between the side rail 78 and the hole 94 and partly encircles the engine exhaust cam shaft 100 with a radial clearance. The other three beams 84, 86 and 88 are substantially identical in structure and function to this beam 90. Thus, the control rod 16 is rotatably supported by the grooves of the other three beams 84, 86 and 88 and held therein by means of bearing caps 102, 104, 106 and 108 rigidly attached to the respective beams 84, 86, 88 and 90. The other pivot shafts 42 are rigidly supported in the holes of the other three beams 84, 86 and 88 with press fit. All of the pivot shafts 42 are arranged in line. The other drive collars 22 are partly encircled by the first cutouts of the other three beams 84, 86 and 88. The engine exhaust cam shaft 100 is rotatably supported, via cam brackets, only one being shown in FIG. 1 at 110, by the engine cylinder head 74, and it is partly encircled by the second cutouts of the other three beams 84, 86 and 88.

Figure 5:
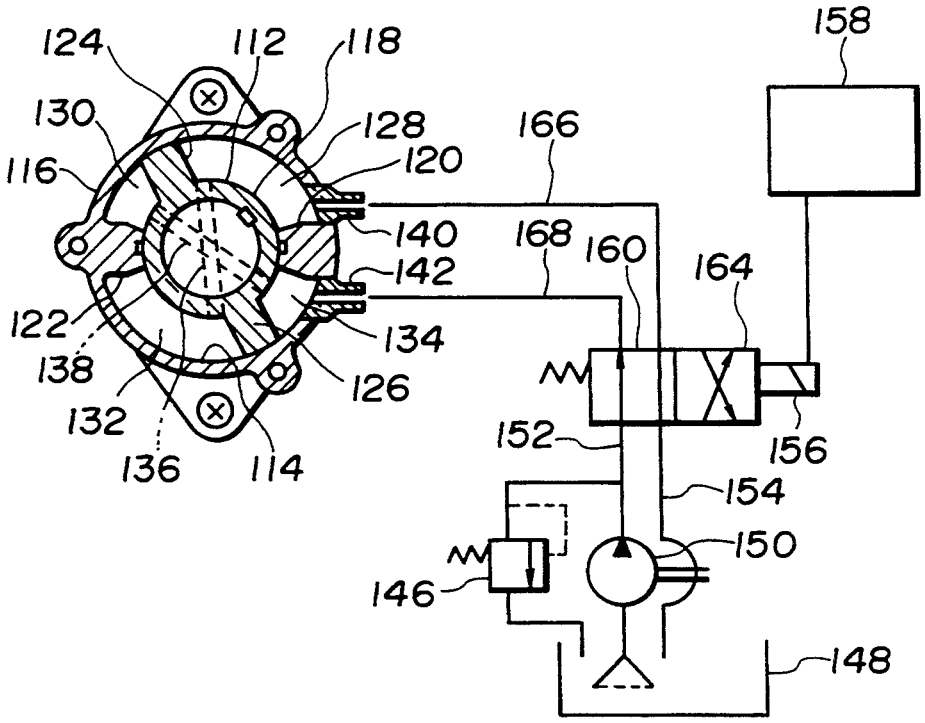
FIG. 5 is a hydraulic circuit diagram including an actuator for driving a control rod.

As shown in FIG. 5, the actuator 20, rigidly attached to the rear end beam 82, is of the vane type. The control rod 16 is rotatable with a turbine 112 disposed in a cylindrical bore 114 of the actuator housing 116. The turbine 112 includes a hub 118 rotatably supported by two partitions 120 and 122 which project inwardly toward each other and are angularly spaced at an angle of 180°. The turbine 112 includes two vanes 124 and 126 radially extending from the hub 118 into the cylindrical bore 114. The vane 124 cooperates with the partition 120 to define a first chamber 128 on one side thereof, while it cooperates with the partition 122 to define a second chamber 130 on the opposite side thereof. The other vane 126, on the other hand, cooperates with the partition 122 to define a third chamber 132 on one side thereof, while it cooperates with the partition 120 to define a fourth chamber 134. The hub 118 has a first radial passage 136 having one end communicating with the first chamber 128 and the opposite end communicating with the third chamber 132. A second radial passage 138, through the hub 118, has one end communicating with the second chamber 130 and the opposite end communicating with the fourth chamber 134. The actuator housing 116 has a first oil supply/discharge port 140 always communicating with the first chamber 128 and a second oil supply/discharge port 142 always communicating with the fourth chamber 134. A two-position valve 144 is fluidly disposed between the actuator 20, a pressure regulator valve 146 and a drainage 148. The pressure regulator valve 146 is supplied with oil discharged by an oil pump 150 and effects pressure regulation to generate oil under regulated pressure. This oil under regulated pressure is supplied to the two-position valve 144 through a supply line 152. A drain line 154 extends from the two-position valve 144 to the drainage 148. The two-position valve 144 is of the electromagnetically operated type including a solenoid 156 whose energization is under the control of a control unit 158. The two-position valve 144 has a spring set first position 160 which is set by a return spring 162 when the solenoid 156 is not energized. Upon energization of the solenoid 156, there is a shift to a second position 164 against the action of the return spring 162. In the second position 164, oil under pressure is supplied to the port 140 via a line 166, while oil is discharged from the port 142 through a line 168, since the supply line 152 is allowed to communicate with the line 166 and the drain line 154 is allowed to communicate with the line 168. Under this condition, due to pressure build-up in the first and third chambers 128 and 132, the turbine 112 is turned counterclockwise to a first angular position, as viewed in FIG. 5. In the spring set first position 160, the supply line 152 and the drain line 154 are connected to the lines 168 and 166, respectively, so that oil under pressure is supplied to the port 142 and oil is discharged from the port 140. Since there is an increase in pressure within the fourth and second chambers 134 and 130, the turbine 112 is turned clockwise, as viewed in FIG. 5, to a second angular position. The control unit 158 receives signals indicative of the engine speed and the intake air flow rate so as to determine whether the solenoid 156 should be energized or not.

The driving shaft 10 is rotated about its axis by the toothed wheel 12 and chain 14. The shaft 10 rotates the drive collar 22. The radial slot 24 is engaged by the pin 26 projecting from the disc 28 and rotates the disc 28. Through the pin 30 and the radial slot 52, the disc 28 rotates the cam 56 which controls the tappets 62 and 64 of the intake valves 66 and 68. If the axis X of the shaft 10 coincides with the axis Y of the disc 28, whose position can be varied by angular displacement of the control rod 16, there is no difference in angular velocity of the shaft 10 and the cam 56. The pin 30 of the disc 28, therefore, causes the radial slot 52 of the cam 56 to rotate at the same angular velocity as the shaft 10.

Let us now suppose that the disc 28 in FIG. 3 is moved down, thus producing an eccentricity between the shaft 10 and the disc 28. If the shaft 10 rotates at a constant speed, the angular velocity of the disc 28 will no longer be equal to that of the shaft 10, but, in the angular position shown in FIG. 3, will be higher than that of the shaft 10. Obviously, by increasing the eccentricity, the difference in angular velocity between the disc 28 and the shaft 10 can be increased (referring to the relative positions of the components enclosed by the rectangle A as shown in FIG. 3). In other words, the disc 28 is at the end of an acceleration phase which has increased its angular velocity to a value higher than the angular velocity of the shaft 10. This value is adjustable within predetermined limits by varying the magnitude of the eccentricity.

When the mechanism is rotated through 180°, the opposite situation occurs, i.e., the angular velocity of the disc 28 is lower than that of the shaft 10.

From the above, it is apparent that there will be a moment between the two situations described in which the angular velocity of the disc 28 and the shaft 10 is equal. This moment will occur whenever the radial plane including the axis of the disc 28 and the pins 26 and 30 is approximately perpendicular to the plane of the drawing FIG. 3.

It is evident that if the shaft 10 and the drive collar 22 rotate at the same speed, the disc 28 will accelerate or decelerate depending on the relative angular and instantaneous angular positions of the various interconnected components. In two relative angular positions, the disc 28 will rotate at a speed equal to that of the shaft 10, while its rotation speed will be higher or lower than that of the shaft 10 in intermediate angular positions.

These variations in relative speed are imparted by the transmission of motion of the disc 28 through the pin 30 and the radial slot 52 to the cam 56, with the result that the cam 56 has maximum and minimum instantaneous velocities.

With the mechanism, the uniform rotation of the driving shaft 10 can be used to make each cam 56 rotate at different speeds, within the limits of the rotational speed of the shaft 10.

The degree of acceleration and deceleration can be adjusted continuously by varying the magnitude of eccentricity.

If now the disc housing 34 is tilted about an axis parallel to the axis of the driving shaft 10, then the phase angle or angularity of the eccentricity will be changed.

Therefore, the mechanism is characterized by the fact that the cams 56 can be moved at varying speeds, using the motion of the driving shaft 10 rotating at a constant speed. This speed variation can be regulated both in amplitude and in phase, and can also be inverted within predetermined limits by adjusting the magnitude and angular direction of eccentricity.

From the above, it is clear that the mechanism can alter the lift and fall times of the intake valves 66 and 68 by directly determining the speed at which the cams 56 rotate, and can modify the opening and closing phases of the valves 66 and 68 as well as governing their motion.

The device functions as follows. During operation at low speed with low load, the control unit 158 causes energization of the solenoid 156, with the result that oil under pressure is supplied via the port 140 to the first chamber 128 and, through the radial passage 136 to the third chamber 132, and the oil is discharged via the port 142 from the fourth and second chambers 134 and 130. This causes a counterclockwise rotation of the turbine 112, viewing in FIG. 5, through a predetermined angle, for example 0. This causes the control rod 16 to rotate counterclockwise, viewing in FIG. 1, about its axis through the same predetermined angle and its eccentric control cam 50 to rotate. This rotational motion of the eccentric control cam 50 causes the eccentric collar 40 to rotate, resulting in movement of the disc housing 34 to produce the eccentricity between the axis Y of disc 28 and the axis X of driving shaft 10. Under this condition, the cams 56 are driven faster than the rotational speed of the driving shaft 10 over one part of the driving shaft revolution and then driven slower than the rotational speed of the shaft 10 over another part of the same revolution. Thus, the lift and fall times of the intake valves 66 and 68 are altered.

For a shift from low speed low load operation to high speed high load engine operation, the control unit 158 causes the solenoid 156 to deenerigize, allowing the return spring 162 to set the two-position valve 144 to the position 160. Under this condition, the oil is discharged via the port 140 from the first and third chambers 128 and 132, and oil under pressure is supplied via the port 142 to the fourth and second chambers 134 and 130. This causes the clockwise return rotation of the turbine 112 through the predetermined angle to the position in which the axis Y of the disc 28 coincides with the axis X of the driving shaft 10. The cams 56 are driven at the same rotational speed as that of the driving shaft 10.

From the description of the framing structure 18, it is evident that sufficient spaces are set forth around spark plug holes 170 as shown in FIG. 2 since the side rails 76 and 78 are arranged to interpose therebetween both the intake and the exhaust valves. Thus, no skilled work is required in installing spark plugs.

As shown in FIG. 1, a rocker cover 172 is rigidly attached directly to the framing structure 18 by means of a plurality of bolts. Since the framing structure 18 has its top with the same configuration as that of the bottom of the rocker cover 172, the framing structure 18 can be united beautifully with the rocker cover 172.

With the pivot shafts 46 arranged near the central longitudinal line of the engine cylinder head 74, the space occupied by the components of the device over the width of the engine cylinder head 74 has been reduced.

Since it is attached directly to the rear end beam 82, the actuator 20 is easy to mount.

With the framing structure 18, the components of the mechanism, such as the control rod 16, pivot shafts 42 and disc housings 34, are supported, resulting in an easy assembly and adjustment. Besides, the radial clearances and centering of the components can be made with increased accuracy.

Since the relative position of the control rod 16 to the framing structure 18 is unaltered, it is easy to center the axis of the disc 28 with the axis of driving shaft 10.

Figure 7:
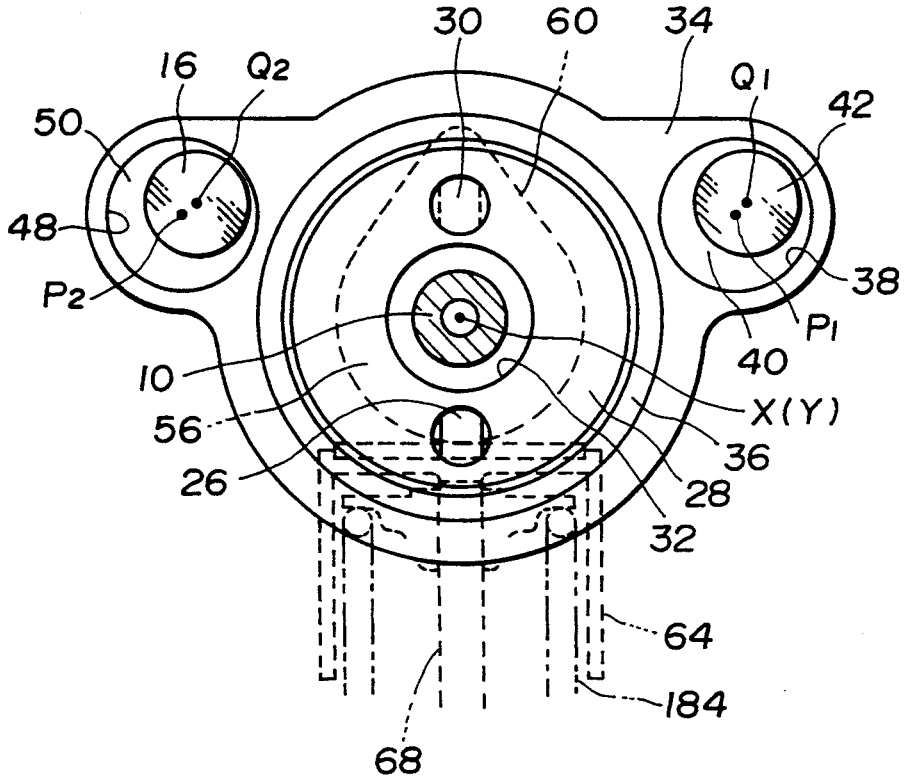
FIG. 7 is a cross section, taken through the line G—G in FIG. 9, showing a modification.
Figure 8:
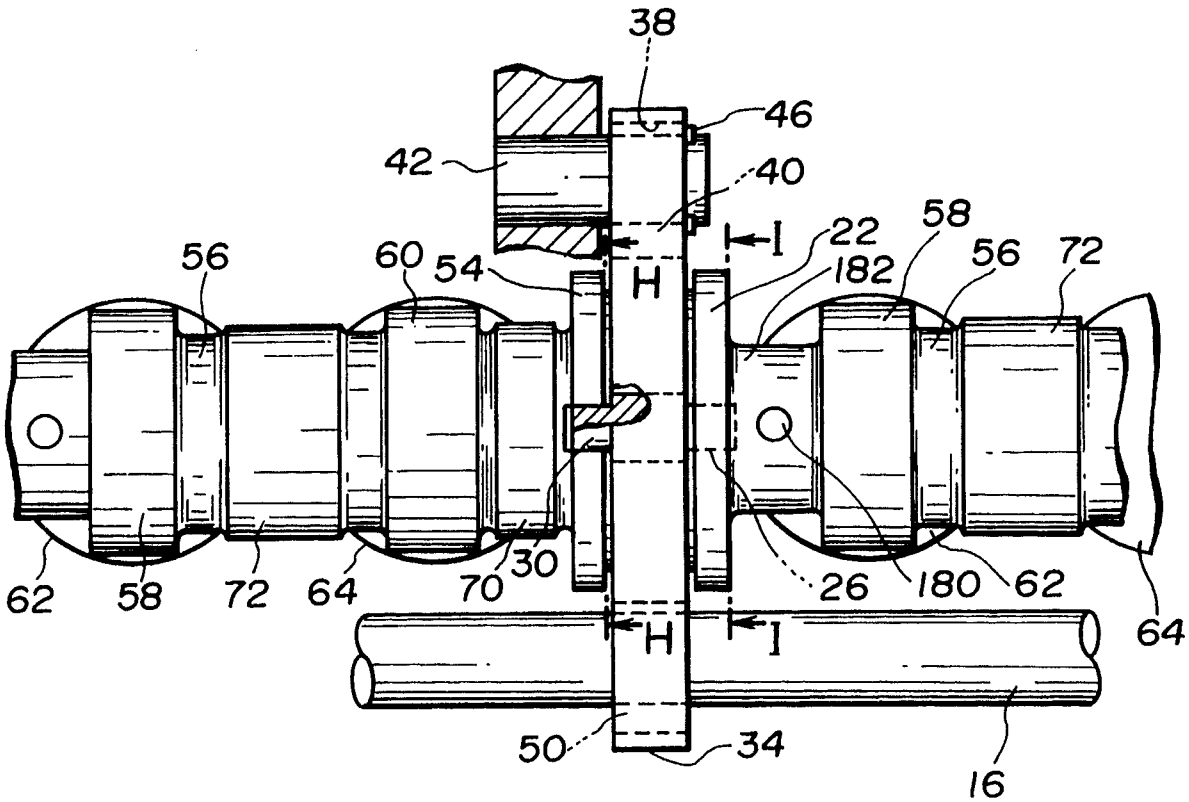
FIG. 8 is a similar view to FIG. 2 showing the modification.
Figure 9:
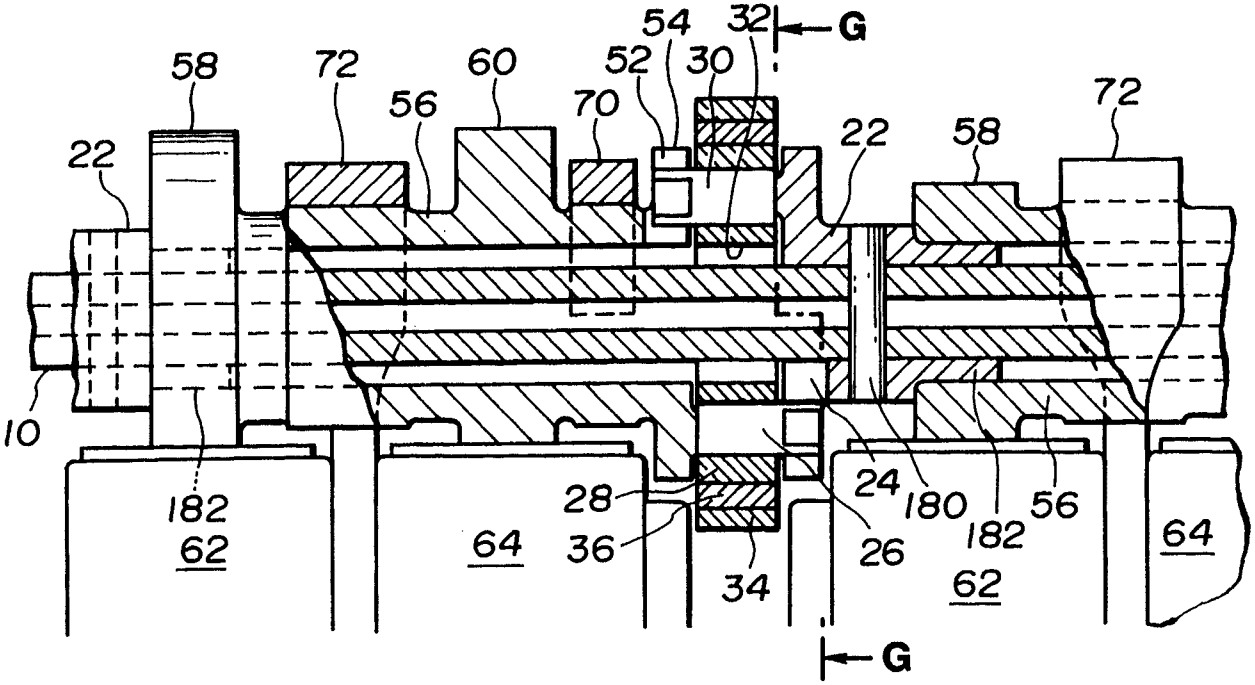
FIG. 9 is a similar view to FIG. 3 showing the modification.
Figure 10:
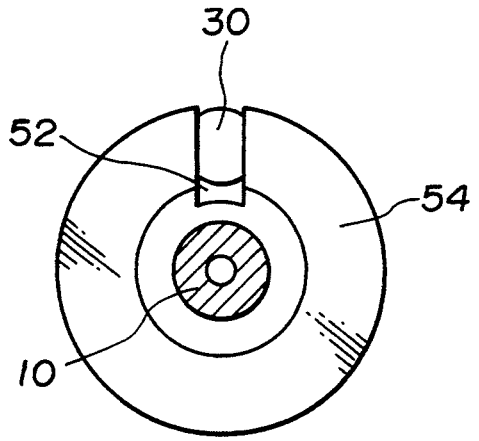
FIG. 10 is a fragmentary cross section taken through the line H—H in FIG. 8.
Figure 11:
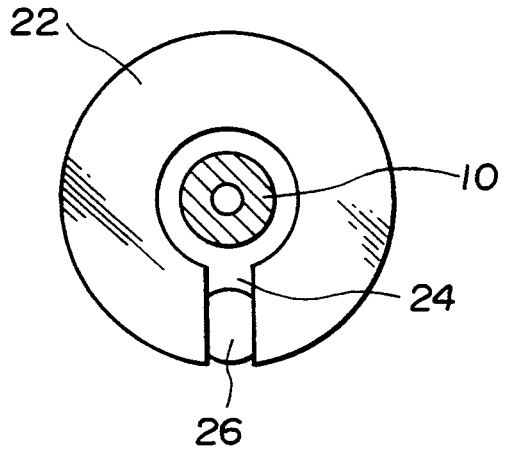
FIG. 11 is a fragmentary cross section taken through the line I—I in FIG. 8.

FIGS. 7 through 12 show a modification of the device. In this modification, a control rod 16, rotatably supported through a suitable structure on the engine cylinder head, and a pivot shaft 42, rigidly supported in a hole of the structure with a press fit, are disposed on the opposite sides of an annular disc 28 and spaced angularly around the axis X of a driving shaft 10 through an angle greater than 90°. As best seen in FIG. 9, a drive collar 22 is rigidly attached to the driving shaft 10 by means of a cotter 180. The drive collar 22 includes an integral sleeve portion 182 inserted into a radial clearance between the shaft 10 and a cam 56 and rotatably supported by the cam 56. In this modification, the driving shaft 10 is indirectly supported by cam brackets 72 and 74 through the sleeves 182 of the drive collars 22 rotatably supported by the cams 56. As best seen in FIGS. 10 and 11, a first pin 26 of the disc 28 is flattened to slidably engage two parallel walls defining a radial slot 24, and a second pin 30 of the disc 28 is flattened to slidably engage two parallel walls defining a radial slot 52. In FIG. 8, it is clearly shown that the annular disc 28 is rotatably supported by a bearing 36 which is supported by a disc housing 34.

Figure 12:
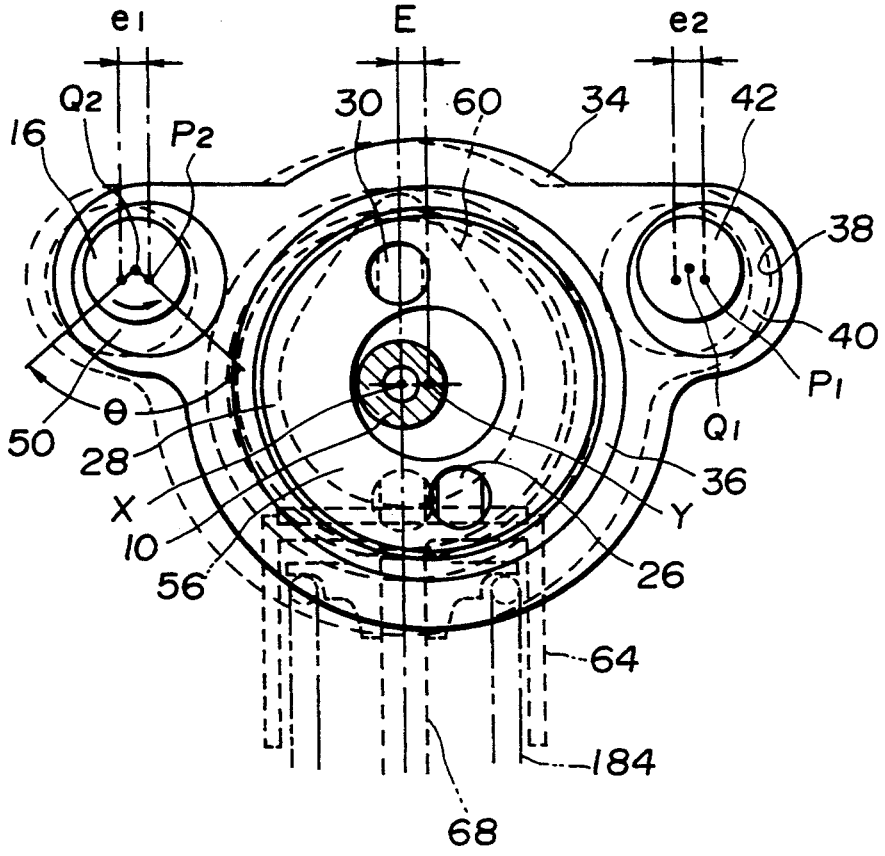
FIG. 12 is a view similar to FIG. 7 showing in the fully drawn line the position of components in which an intermediate member produces the eccentricity.

Referring to FIGS. 7 and 12, FIG. 7 shows the position of the components when the axis Y of the disc 28 coincides with the axis X of the driving shaft 10, while FIG. 12 shows in the fully drawn line the position of the components to produce an eccentricity after counterclockwise rotation, viewing in FIG. 12, of the control rod 16 through an angle $\theta$. In FIG. 12, the broken line shows the same position of the components as that shown in FIG. 7. From FIG. 12, it is evident that the counterclockwise rotation, through the angle $\theta$, of the control rod 16 about its axis $Q_2$ causes displacement of the axis of the eccentric control cam 50 through a magnitude $e_1$ to a point $P_2$, causing an eccentric collar 40 to rotate relative to the pivot shaft 42 around a pivot shaft axis $Q_1$, resulting in a displacement of an axis of the eccentric collar 40 through a magnitude $e_2$ to a point $P_1$. Due to movement of the disc housing 34 resulting from the movement of the eccentric control cam 50 and that of the eccentric collar 40, the axis Y of the disc 28 moves to the right as viewed in FIG. 12 by a magnitude of displacement E.

With the eccentric control cam 50 and the eccentric collar 40, the disc housing 34 is supported by the control rod 16 and the pivot shaft 42. This supporting structure is found to be very effective in reducing noise and suppressing wear due to alternating torque imparted thereto by the cams 56 which are subjected to reaction by valve springs 184 of the intake valves.

FIGS. 13 through 17 show a second embodiment. This embodiment is substantially the same as the first embodiment except for the provision of a framing structure which is modified to support a common pivot shaft on the remote side of the cam brackets from the spark plug holes drilled through the engine cylinder head. One of two side rails is supported at a portion on the engine cylinder head between the cam brackets and the spark plug holes. In this second embodiment, instead of the eccentric collars rotatably supported by the respective pivot shafts which are press fitted to the respective beams, the common pivot shaft is rotatably supported by beams, and disc housings have slots slidably engaged by the common pivot shaft for rotational movement thereof with the common pivot shaft and for radial movement thereof relative to the common pivot shaft.

Figure 4:
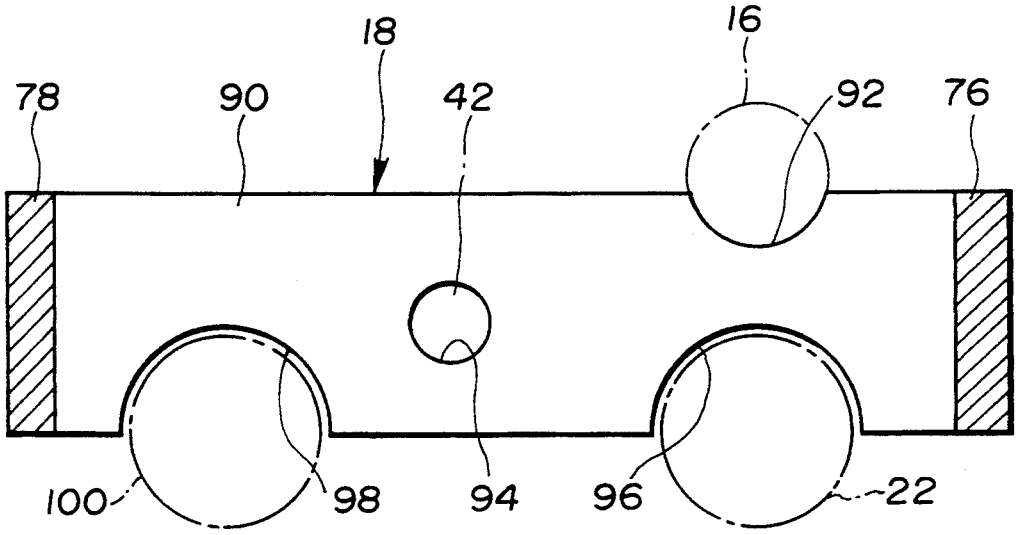
FIG. 4 is a fragmentary view of FIG. 1 with unnecessary components removed to show structure of a beam.
Figure 13:
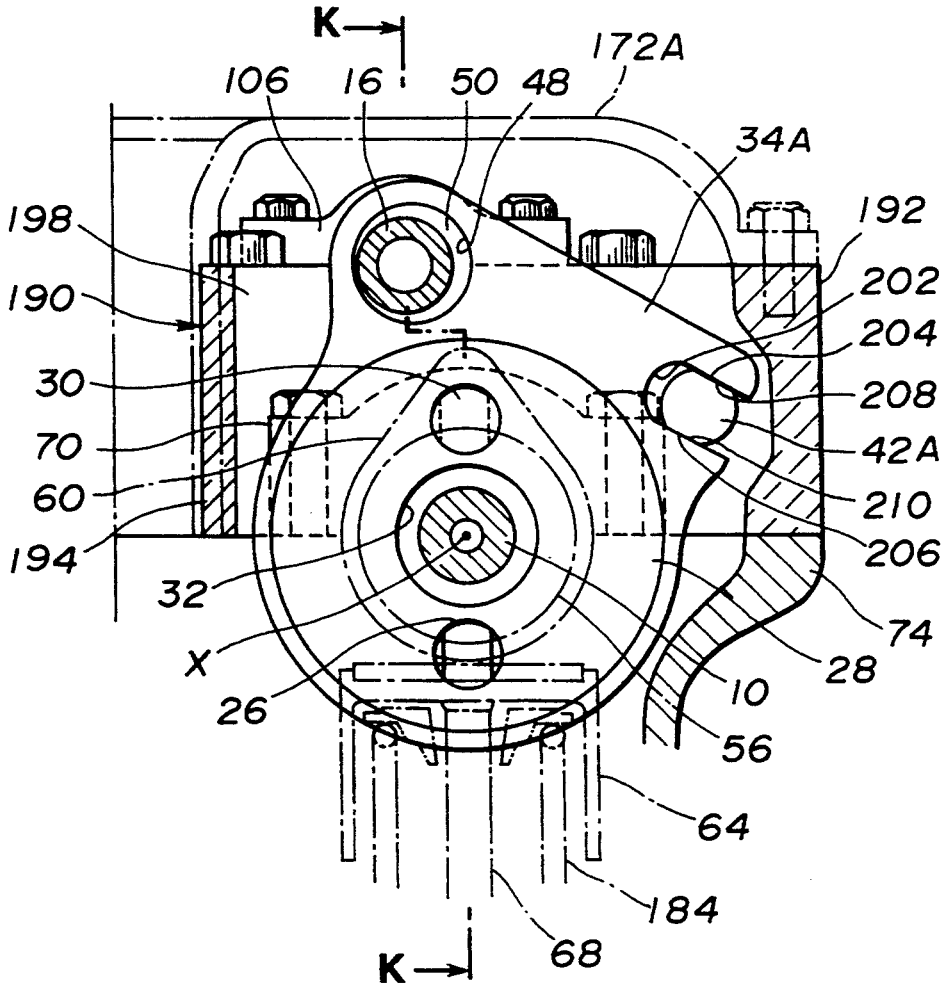
FIG. 13 is a cross section, taken through the line J—J shown in FIG. 15, showing a second embodiment of a cam shaft assembly.
Figure 14:
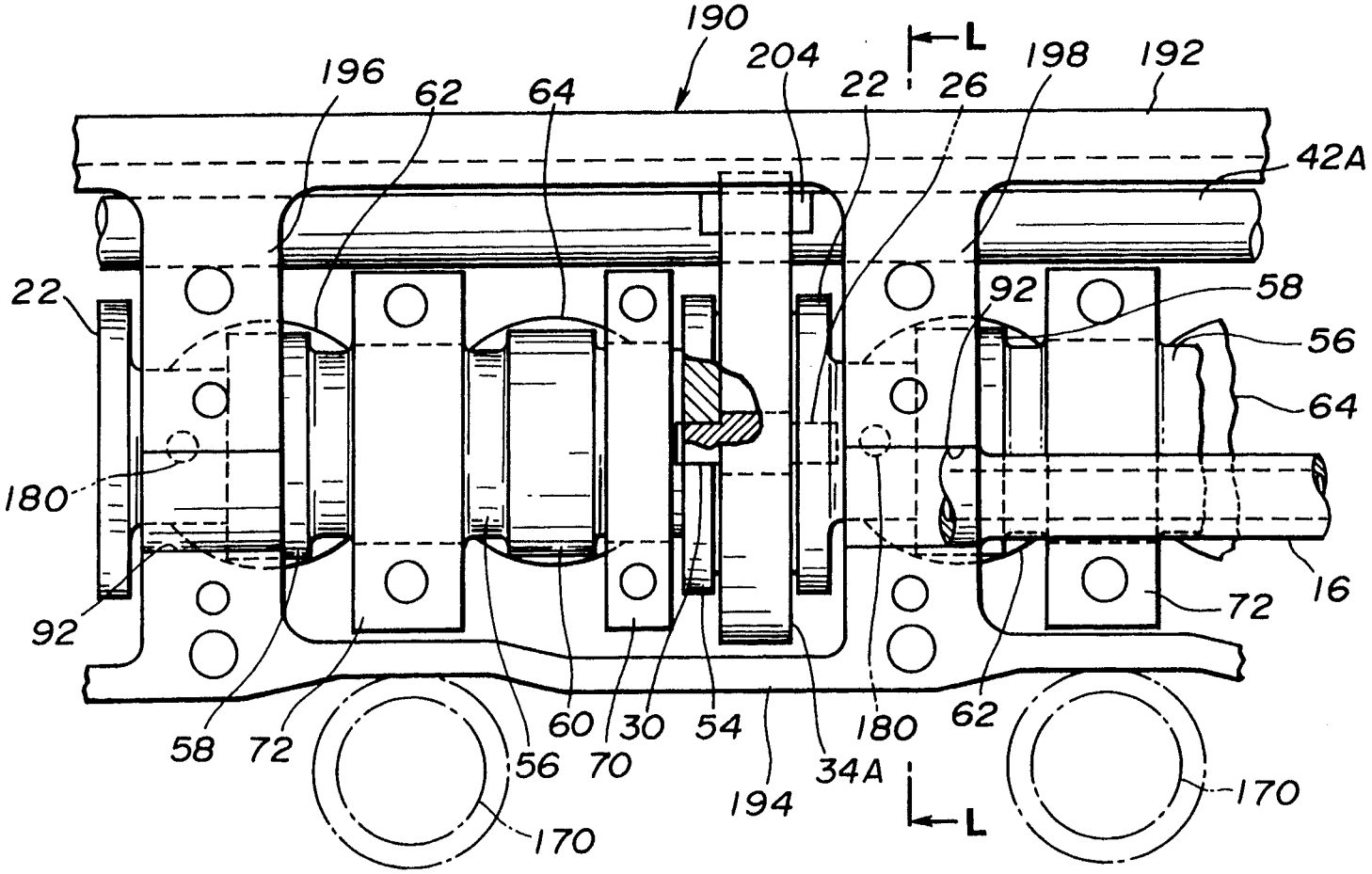
FIG. 14 is a similar view to FIG. 2 showing the assembly shown in FIG. 13.
Figure 15:
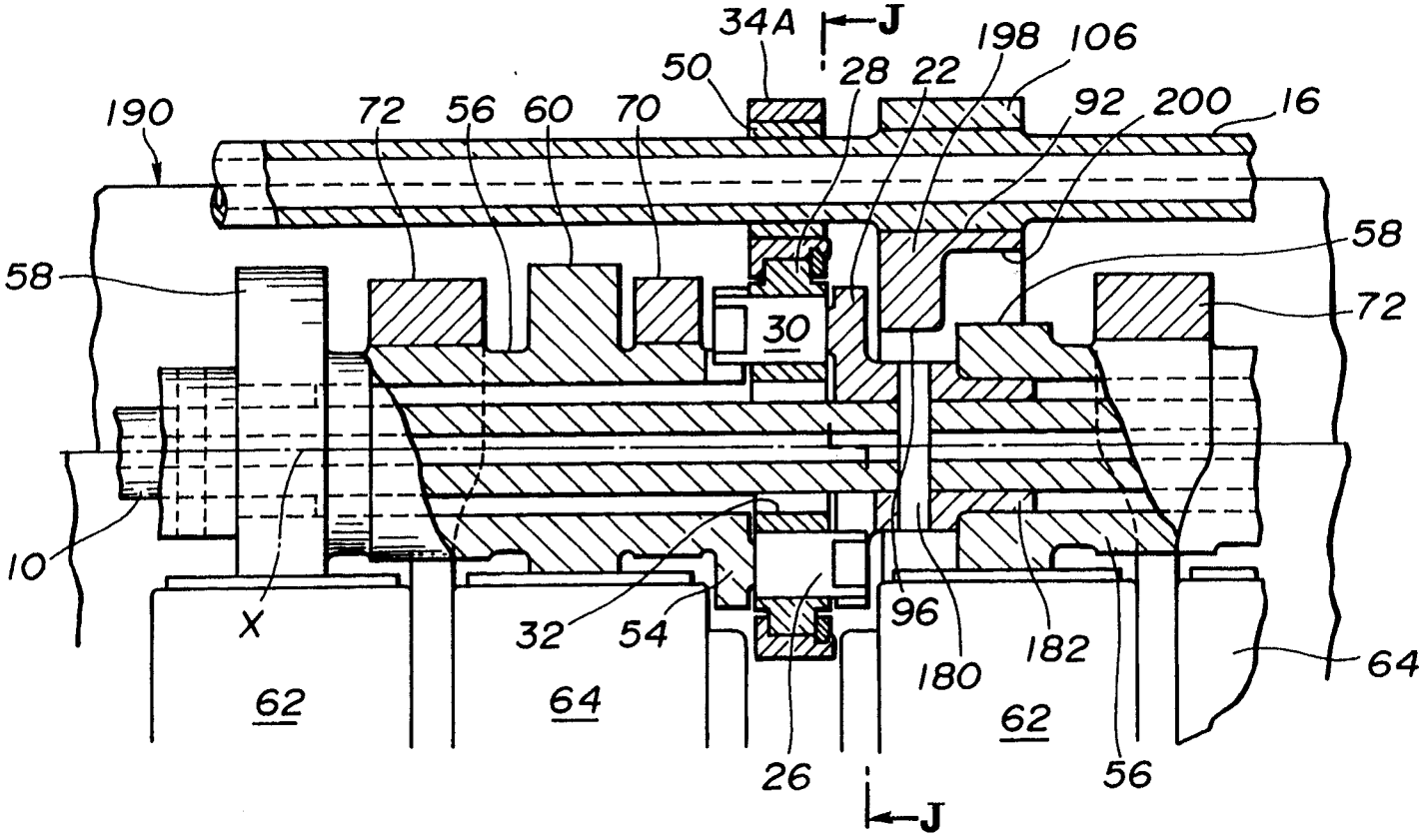
FIG. 15 is a longitudinal section, taken through the line K—K in FIG. 13.
Figure 16:
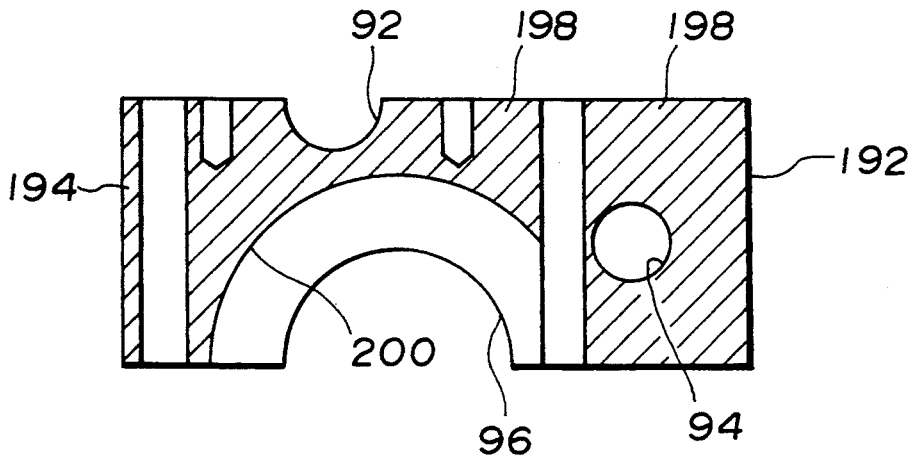
FIG. 16 is a cross section, taken through the line L—L in FIG. 14, with unnecessary components removed to show a beam.

FIG. 14 shows an intermediate portion of the modified framing structure 190 having an outer side rail 192 and an inner side rail 194 interconnected by beams, only two being shown at 196 and 198. The outer side rail 192 is supported by the engine cylinder head at substantially the same location as the side rail 76 (see FIG. 2) is, but the inner side rail 194 is supported at a location between cam brackets 70, 72 and spark plug holes 170. Comparison of FIG. 16 with FIG. 4 reveals the similarity of the beams 196 or 198 used in the framing structure 190 to the beams 84, 86, 88 or 90 used in the framing structure 18 shown in FIG. 2. In FIG. 16, the same reference numerals as used in FIG. 4 are used to designate the same portions for ease of comparison. In contrast to the beam shown in FIG. 4, the hole 94 for supporting a common pivot shaft 42A is disposed between the cutout 96 and the outer side rail 192, and the cutout 96 connects with an enlarged cutout 200. This enlarged cutout 200 is cut in the beam 198 to allow insertion of not only a drive collar 22, but also the adjacent cam 56 which allows insertion thereinto of a sleeve 182 of the drive collar 22. As shown in phantom line in FIG. 13, a modified rocker cover 172A can be directly attached to the top of the framing structure 190. Although not shown in FIG. 14, a control rod 16 is rotatably supported by the grooves 92 of the beams 196 and 198 and drivingly coupled with an actuator in the same manner as in the first embodiment. The components of the mechanism shown in this embodiment are interconnected in the same manner as in the modification described in connection with FIGS. 7 to 12.

Figure 17:
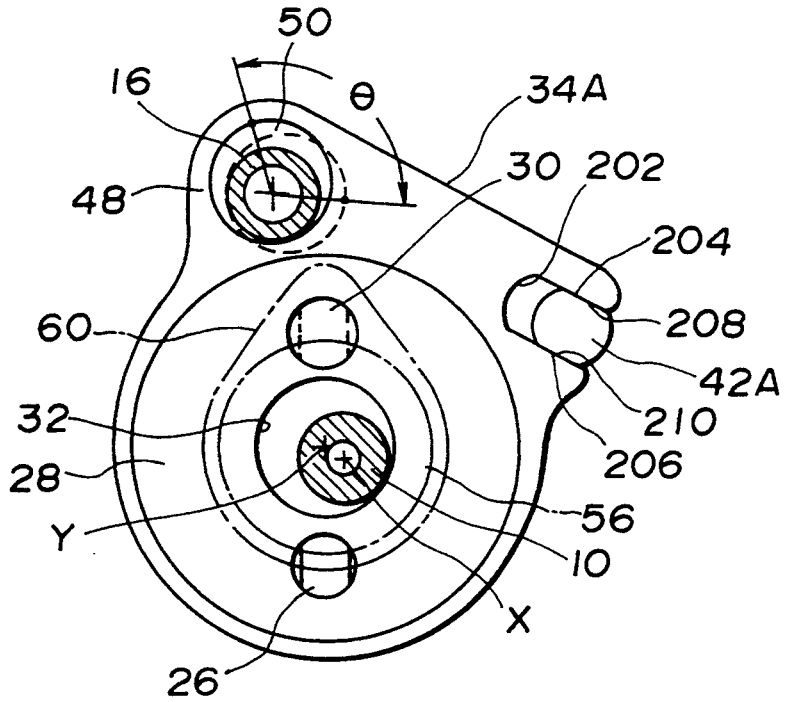
FIG. 17 is a view similar to FIG. 13 showing in the fully drawn line the position of components in which an intermediate member produces the eccentricity.

In this second embodiment, the common pivot shaft 42A, rotatably supported by the beams 196 and 198, is received in a slot 202 cut into a disc housing 34A as shown in FIG. 13. For rotational movement or tilting of the disc housing 34A with the common pivot shaft 42A, while allowing radial movement of the disc housing 34A relative to the pivot shaft 42A, the pivot shaft 42A has two parallel opposite flat faces 204 and 206 slidably engaged with two parallel flat walls 208 and 210 of the slot 202. This slot and pivot shaft mechanism assures smooth movement of the disc housing 34A following eccentric movement of an eccentric control cam 50. FIG. 13 shows the position of the components of the device in which the axis Y of the disc 28 coincides the axis X of the driving shaft 10, and FIG. 17 shows the position of the components in which the eccentricity is produced as a result of rotation of the control rod 16 through an angle of $\theta$.

Figure 18:
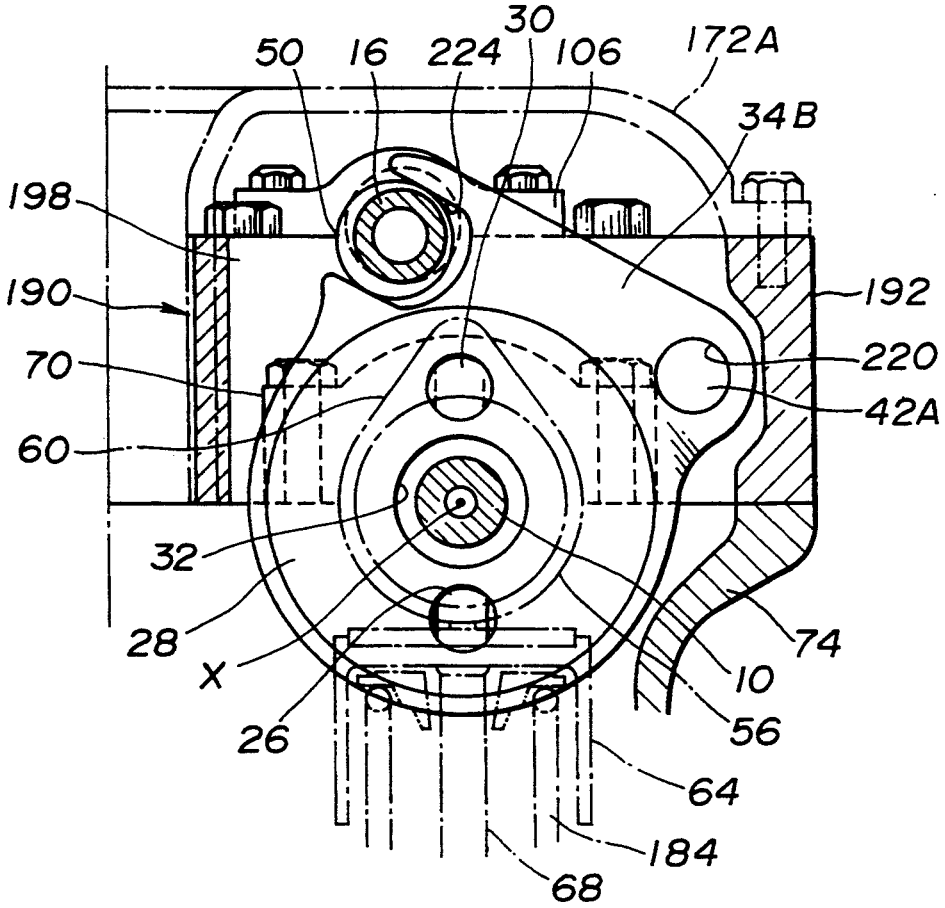
FIG. 18 is a similar view to FIG. 13, showing a third embodiment of a cam shaft assembly.

FIG. 18 shows a third embodiment. This embodiment is substantially the same as the second embodiment except the manner of supporting disc housings on a common pivot shaft 42A and eccentric control cams 50.

In this embodiment, the common pivot shaft 42A is engaged in a hole 220 drilled through a disc housing 34B with the result that the disc housing 34B can tilt about the axis of the pivot shaft 42A. An eccentric control cam 50 integral with a control rod 16 is slidably engaged in a slot 224 cut in the disc housing 34B. This slot 224 slides on the eccentric control cam 50 to allow smooth tilting of the disc housing 34B.

Figure 19:
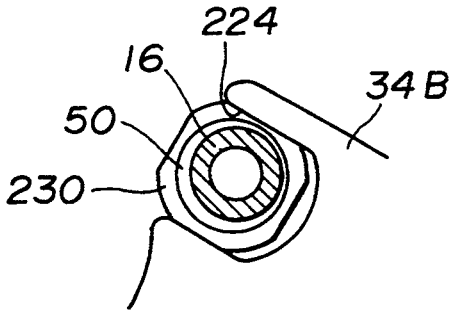
FIG. 19 is a fragmentary view of FIG. 18, showing a modification.
Figure 20:
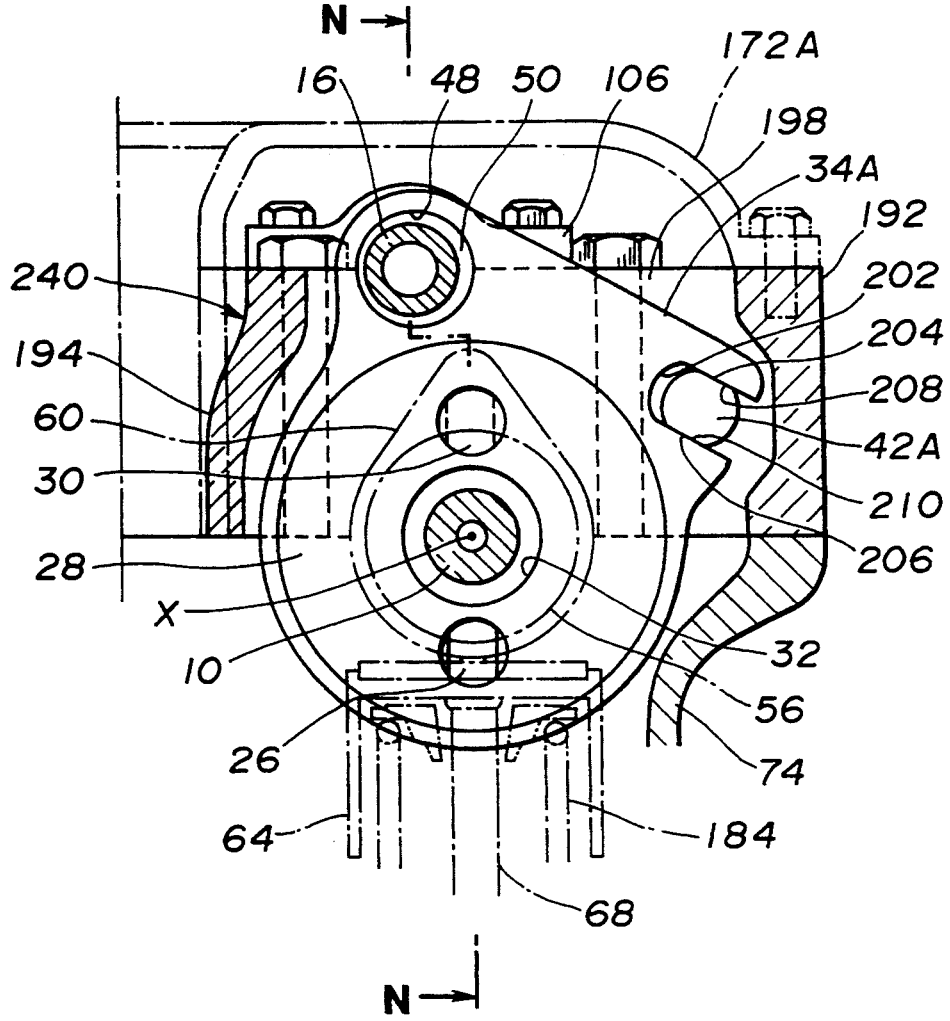
FIG. 20 is a cross section, taken through the line M—M shown in FIG. 22, showing a fourth embodiment of a cam shaft assembly.
Figure 21:
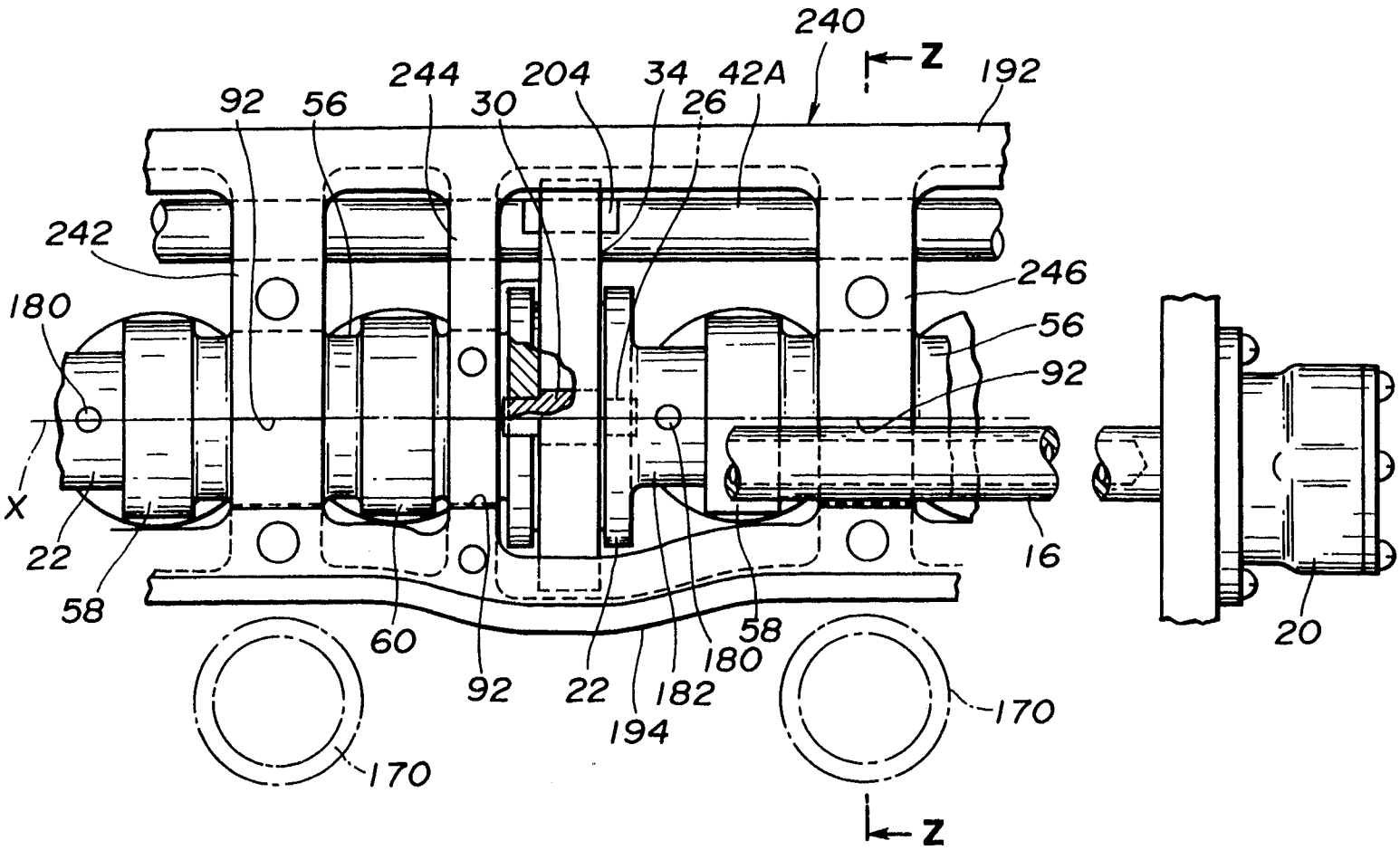
FIG. 21 is a similar view to FIG. 2 showing the assembly shown in FIG. 20.
Figure 22:
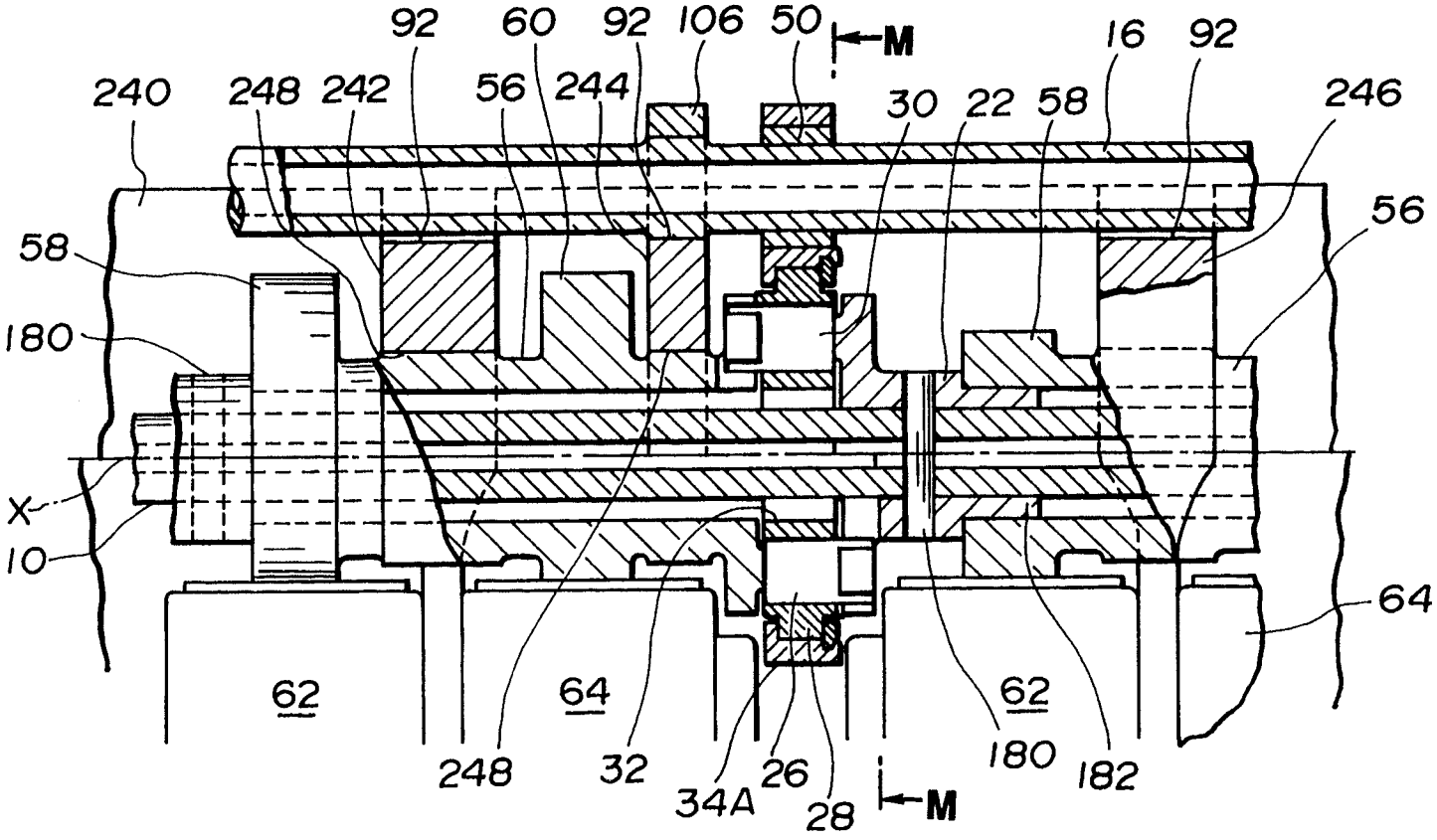
FIG. 22 is a longitudinal section, taken through the line N—N in FIG. 20.

In order to reduce wear due to frictional engagement of the eccentric cam 50 with the walls of the slot 224, a spacer 230 may be fitted around the eccentric control cam 50 as shown in FIG. 19.

FIGS. 20 to 23 show a fourth embodiment which is substantially identical to the second embodiment described in connection with FIGS. 13 to 17.

Figure 23:
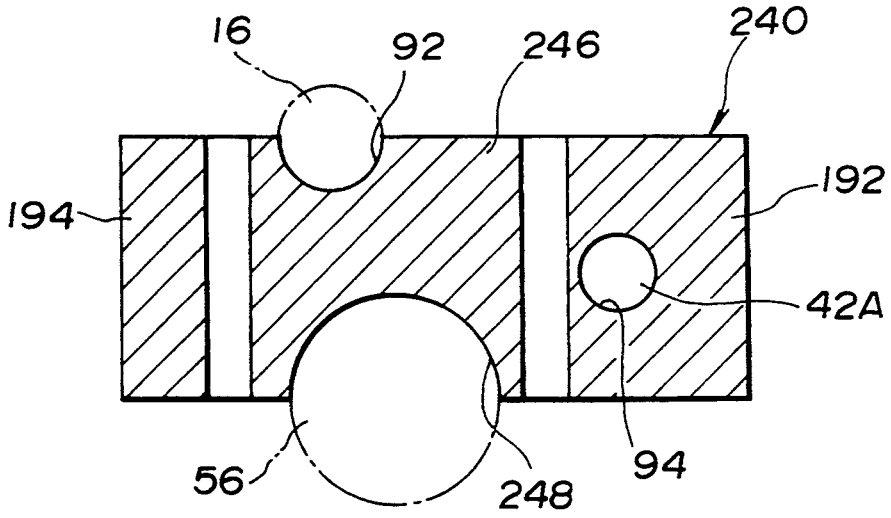
FIG. 23 is a cross section, taken through the line Z—Z in FIG. 21, with unnecessary components removed to show a beam.

This fourth embodiment is, however, different from the second embodiment in the provision of a further modified framing structure instead of the framing structure 190. A framing structure 240 has great similarity to the framing structure 190. However, beams 242, 244 and 346 of the framing structure 240 serve as cam brackets for rotatably supporting cams as will be seen from FIGS. 21 and 22. Thus, separate cam brackets are not used in this embodiment. As best seen in FIG. 23, the beam 246 has a circular bearing groove 248 for rotatably supporting the associated cam 56.

What is claimed is:

1. A cam shaft assembly for use in an internal combustion engine with a cylinder head to control opening and closing of intake and exhaust valves thereof, the assembly comprising:

a driving shaft rotatable about a shaft axis;

a cam rotatable relative to said driving shaft, said cam having a drive connection from said driving shaft which includes a drive member rotatable with said driving shaft, a support, an intermediate member supported in said support for rotation about an axis so as to rotate eccentrically with respect to said shaft axis, a first coupling between said drive member and said intermediate member at a first position spaced from said shaft axis, and a second coupling between said intermediate member and said cam at a second position angularly spaced from said first position with respect to said shaft axis, said first and second couplings being so spaced from said shaft axis that they are at varying distances from the axis of said intermediate member during operation, each of said first and second couplings having a movable connection with said intermediate member to permit variation in its distance from said axis of said intermediate member;

means for holding said support for movement within a plane perpendicular to said shaft axis; and means for varying the eccentricity of said intermediate member, wherein said eccentricity varying means includes a control rod mounted for rotation about an axis, said control rod having an eccentric control cam, said support holding means includes pivot means for allowing movement of said support following said control cam, and said support has a hole rotatably coupled with said eccentric control cam.

2. A cam shaft assembly for use in an internal combustion engine with a cylinder head to control opening and closing of intake and exhaust valves thereof, the assembly comprising:

a driving shaft rotatable about a shaft axis;

a cam rotatable relative to said driving shaft, said cam having a drive connection from said driving shaft which includes a drive member rotatable with said driving shaft, a support, an intermediate member supported in said support for rotation about an axis so as to rotate eccentrically with respect to said shaft axis, a first coupling between said drive member and said intermediate member at a first position spaced from said shaft axis, and a second coupling between said intermediate member and said cam at a second position angularly spaced from said first position with respect to said shaft axis, said first and second couplings being so spaced from said shaft axis that they are at varying distances from the axis of said intermediate member during operation, each of said first and second couplings having a movable connection with said intermediate member to permit variation in its distance from said axis of said intermediate member;

means for holding said support for movement within a plane perpendicular to said shaft axis; and means for moving said support to vary the eccentricity of said intermediate member;

wherein said support has a hole, and said support moving means includes an eccentric control cam rotatably coupled in said hole.

3. A cam shaft assembly for use in an internal combustion engine with a cylinder head to control opening and closing of intake and exhaust valves thereof, the assembly comprising:

a driving shaft rotatable about a shaft axis;

a cam rotatable relative to said driving shaft, said cam having a drive connection from said driving shaft which includes a drive member rotatable with said driving shaft, a support, an intermediate member supported in said support for rotation about an axis so as to rotate eccentrically with respect to said shaft axis, a first coupling between said drive member and said intermediate member at a first position spaced from said shaft axis, and a second coupling between said intermediate member and said cam at a second position angularly spaced from said first position with respect to said shaft axis, said first and second couplings being so spaced from said shaft axis that they are at varying distances from the axis of said intermediate member during operation, each of said first and second couplings having a movable connection with said intermediate member to permit variation in its distance from said axis of said intermediate member;

means for holding said support for movement within a plane perpendicular to said shaft axis; and means for varying the eccentricity of said intermediate member, wherein said eccentricity varying means includes a control rod mounted for rotation about an axis, said control rod having a control cam for controlling movement of said support, and said support holding means includes pivot means for allowing movement of said support following said control cam;

wherein said control cam is in the form of an eccentric control cam forming an integral part of said control rod;

wherein said pivot means includes a pivot shaft, and said support holding means includes an eccentric collar fitted on said pivot shaft for relative rotation to said pivot shaft, and a hole through said support for fitting said eccentric collar for allowing relative rotation of said support to said eccentric collar.

4. A cam shaft assembly as claimed in claim 3, wherein said eccentricity varying means includes a hole through said support for fitting said eccentric control cam.

5. A cam shaft assembly as claimed in claim 3, further comprising a framing structure including a beam having a groove rotatably supporting said control rod and a hole supporting said pivot shaft.

6. A cam shaft assembly as claimed in claim 5, wherein said pivot shaft is press fitted into said hole of said beam.

7. A cam shaft assembly as claimed in claim 6, wherein said beam has a cutout for allowing insertion of said drive member.

8. A cam shaft assembly as claimed in claim 7, wherein said framing structure includes first and second side rails interconnected by said beam, said first and second side rails being adapted to be supported on the cylinder head to interpose therebetween the intake and exhaust valves.

9. A cam shaft assembly as claimed in claim 8, wherein said beam extends over the intake and exhaust valves upon installation on the cylinder head.

10. A cam shaft assembly for use in an internal combustion engine with a cylinder head to control opening and closing of intake and exhaust valves thereof, the assembly comprising:

a driving shaft rotatable about a shaft axis;

a cam rotatable relative to said driving shaft, said cam having a drive connection from said driving shaft which includes a drive member rotatable with said driving shaft, a support, an intermediate member supported in said support for rotation about an axis so as to rotate eccentrically with respect to said shaft axis, a first coupling between said drive member and said intermediate member at a first position spaced from said shaft axis, and a second coupling between said intermediate member and said cam at a second position angularly spaced from said first position with respect to said shaft axis, said first and second couplings being so spaced from said shaft axis that they are at varying distances from the axis of said intermediate member during operation, each of said first and second couplings having a movable connection with said intermediate member to permit variation in its distance from said axis of said intermediate member;

means for holding said support for movement within a plane perpendicular to said shaft axis; and means for varying the eccentricity of said intermediate member, wherein said eccentricity varying means includes a control rod mounted for rotation about an axis, said control rod having a control cam for controlling movement of said support, and said support holding means includes pivot means for allowing movement of said support following said control cam;

wherein said control cam is in the form of an eccentric control cam forming an integral part of said control rod;

wherein said pivot means includes a pivot shaft mounted for rotation about an axis spaced in parallel from said rod axis, and said support holding means includes a slot cut in said support, said pivot shaft fits in said slot for rotation of said support with said pivot shaft and for radial movement of said support relative to said pivot shaft.

11. A cam shaft assembly as claimed in claim 10, further comprising a framing structure including a beam having a groove for rotatably supporting said control rod and a hole for rotatably supporting said pivot shaft.

12. A cam shaft assembly as claimed in claim 11, wherein said beam has a bearing groove serving as a cam bracket and rotatably supporting said cam.

13. A cam shaft assembly for use in an internal combustion engine with a cylinder head to control opening and closing of intake and exhaust valves thereof, the assembly comprising:

a driving shaft rotatable about a shaft axis;

a cam rotatable relative to said driving shaft, said cam having a drive connection from said driving shaft which includes a drive member rotatable with said driving shaft, a support, an intermediate member supported in said support for rotation about an axis so as to rotate eccentrically with respect to said shaft axis, a first coupling between said drive member and said intermediate member at a first position spaced from said shaft axis, and a second coupling between said intermediate member and said cam at a second position angularly spaced from said first position with respect to said shaft axis, said first and second couplings being so spaced from said shaft axis that they are at varying distances from the axis of said intermediate member during operation, each of said first and second couplings having a movable connection with said intermediate member to permit variation in its distance from said axis of said intermediate member;

means for holding said support for movement within a plane perpendicular to said shaft axis; and means for varying the eccentricity of said intermediate member, wherein said eccentricity varying means includes a control rod mounted for rotation about an axis, said control rod having a control cam for controlling movement of said support, and said support holding means includes pivot means for allowing movement of said support following said control cam;

wherein said control cam is in the form of an eccentric control cam forming an integral part of said control rod;

wherein said pivot means includes a pivot shaft mounted for rotation about an axis spaced parallel from said rod axis, and said support holding means includes a hole through said support, and said hole fits said pivot shaft for rotation of said support about an axis of said pivot shaft;

wherein said eccentricity varying means includes a slot cut in said support, said slot receiving said eccentric control cam;

wherein said slot is in slidable engagement with said eccentric control cam.

14. A cam shaft assembly for use in an internal combustion engine with a cylinder head to control opening and closing of intake and exhaust valves thereof, the assembly comprising:

a driving shaft rotatable about a shaft axis;

a cam rotatable relative to said driving shaft, said cam having a drive connection from said driving shaft which includes a drive member rotatable with said driving shaft, a support, an intermediate member supported in said support for rotation about an axis so as to rotate eccentrically with respect to said shaft axis, a first coupling between said drive member and said intermediate member at a first position spaced from said shaft axis, and a second coupling between said intermediate member and said cam at a second position angularly spaced from said first position with respect to said shaft axis, said first and second couplings being so spaced from said shaft axis that they are at varying distances from the axis of said intermediate member during operation, each of said first and second couplings having a movable connection with said intermediate member to permit variation in its distance from said axis of said intermediate member;

means for holding said support for movement within a plane perpendicular to said shaft axis; and means for varying the eccentricity of said intermediate member, wherein said eccentricity varying means includes a control rod mounted for rotation about an axis, said control rod having a control cam for controlling movement of said support, and said support holding means includes pivot means for allowing movement of said support following said control cam;

wherein said control cam is in the form of an eccentric control cam forming an integral part of said control rod;

wherein said pivot means includes a pivot shaft mounted for rotation about an axis spaced parallel from said rod axis, and said support holding means includes a hole through said support, and said hole fits said pivot shaft for rotation of said support about an axis of said pivot shaft;

wherein said eccentricity varying means includes a slot cut in said support, said slot receiving said eccentric control cam;

wherein a spacer is disposed between said eccentric control cam and said slot.

* * * * *